US006634918B1

(12) United States Patent
Chernick et al.

(10) Patent No.: US 6,634,918 B1
(45) Date of Patent: Oct. 21, 2003

(54) DEVICE AND METHOD FOR GENERATING, SUPPORTING AND ILLUMINATING BUBBLES

(76) Inventors: Mark Chernick, 19180 144$^{th}$ Ave. NE., Woodinville, WA (US) 98072; Webb Nelson, 19180 144$^{th}$ Ave. NE., Woodinville, WA (US) 98072

( * ) Notice: Subject to any disclaimer, the term of this patent is extended or adjusted under 35 U.S.C. 154(b) by 0 days.

(21) Appl. No.: 10/167,981

(22) Filed: Jun. 13, 2002

(51) Int. Cl.$^{7}$ ..... A63H 33/28
(52) U.S. Cl. ..... 446/15; 446/16
(58) Field of Search ..... 446/15, 16, 17, 446/18, 19, 20, 21

(56) References Cited

U.S. PATENT DOCUMENTS 2,842,894 A * 7/1958 Walden
3,060,626 A * 10/1962 Panico, Jr.
5,416,994 A * 5/1995 McLaughlin ..... 40/406
6,062,936 A * 5/2000 Rudell et al. ..... 446/71
6,406,347 B2 * 6/2002 Swagel et al. ..... 446/16
6,416,377 B1 * 7/2002 Bart ..... 446/15
2002/0061697 A1 * 5/2002 Hornsby et al. ..... 446/15

* cited by examiner

*Primary Examiner*—Derris H. Banks
*Assistant Examiner*—Ali F Abdelwahed
(74) *Attorney, Agent, or Firm*—LaMorte & Associates

(57) ABSTRACT

A device that holds bubble blowing supplies, retains blown bubbles and illuminates the blown bubbles that are retained. The device includes a housing. Bubble blowing supplies are selectively stored within the housing. On the exterior of the housing is a bubble support platform. The bubble support platform is concave to reduce the stresses a bubble experiences when it rests against this surface. Below the bubble support platform is at least one light source. As each light source is activated, the light source shines light into the area immediately above the bubble support platform. Consequently, when a bubble is formed and is placed on the bubble support platform, the light sources shine light into the bubble, thereby internally illuminating the bubble.

17 Claims, 4 Drawing Sheets

DEVICE AND METHOD FOR GENERATING, SUPPORTING AND ILLUMINATING BUBBLES

BACKGROUND OF THE INVENTION

1. Field of the Invention

In general, the present invention relates to amusement devices that are used to generate and support bubbles. More particularly, the present invention relates to bubble blowing devices and objects that are used to manipulate the bubbles after they have been blown.

2. Description of the Prior Art

Bubble blowing devices have been popular with children for many generations. In that time, bubble blowing devices have been created in countless designs and styles. As such, the prior art is replete with many different types of bubble blowing devices.

Novelty bubbles usually come in one of two types. The first type of bubble is a soap film bubble. With a soap film bubble, the surface tension of the soap film creates the skin of the bubble. As soon as the soap film dries or is punctured, the bubble pops. Accordingly, soap film bubbles have a typical life expectancy of less than ten seconds.

The second type of bubble is the polymer film bubble. Polymer film bubbles use a highly elastic polymer to create the skin of the bubble. With many types of polymer films, even if the bubble is pierced, the bubble does not pop. Rather, the polymer film of the bubble maintains its shape until it is manually compressed and reused.

Bubble blowing devices typically have the same functioning elements. A reservoir is provided for holding soap film or polymer material. An annular structure is provided to dip into the soap film or polymer material. A stream of air is then blown through the annular structure, thereby creating bubbles from the soap film or polymer material.

Typically, after a bubble is formed, the bubble is left to float freely in the wind. Soap film bubbles quickly pop and are lost. With soap film bubbles, children are amused by creating the bubbles and by trying to catch the bubbles in the short period of time before they naturally pop. However, with the advent of polymer film bubbles, bubbles have taken on a new play value. Polymer film bubbles last for long periods of time. Accordingly, children now have the opportunity to interconnect bubbles and make complex designs from bubbles.

The present invention is a device that makes playing with either soap film bubbles or polymer film bubbles more fun. The present invention contains the bubble making equipment needed by a child to create bubbles The device also provides a support for holding a plurality of bubbles in a complex formation. Lastly, the present invention provides a means for illuminating the bubbles held on the support, thereby creating a highly visually appealing display that is internally illuminated.

SUMMARY OF THE INVENTION

The present invention is a device that holds bubble blowing supplies, retains blown bubbles and illuminates the blown bubbles that are retained. The device includes a housing. Bubble blowing supplies are selectively stored within the housing. On the exterior of the housing is a bubble support platform. The bubble support platform is concave to reduce the stresses a bubble experiences when it rests against this surface. Below the bubble support platform is at least one light source. As each light source is activated, the light source shines light into the area immediately above the bubble support platform. Consequently, when a bubble is formed and is placed on the bubble support platform, the light sources shine light into the bubble, thereby internally illuminating the bubble.

The light sources can be selectively controlled to shine in a predetermined flash pattern or to shine different colored light at different times. As a consequence, any bubble on the bubble support platform can be illuminated using a complex sequence of changing colored light.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

The present invention is a device that holds bubble blowing supplies, retains blown bubbles and illuminates the bubbles that are retained. The shape of the present invention device is not of importance and it should be understood that the housing of the device can be shaped in any manner, provided the housing supports the functioning elements that are described below in the exemplary embodiment.

Figure 1:
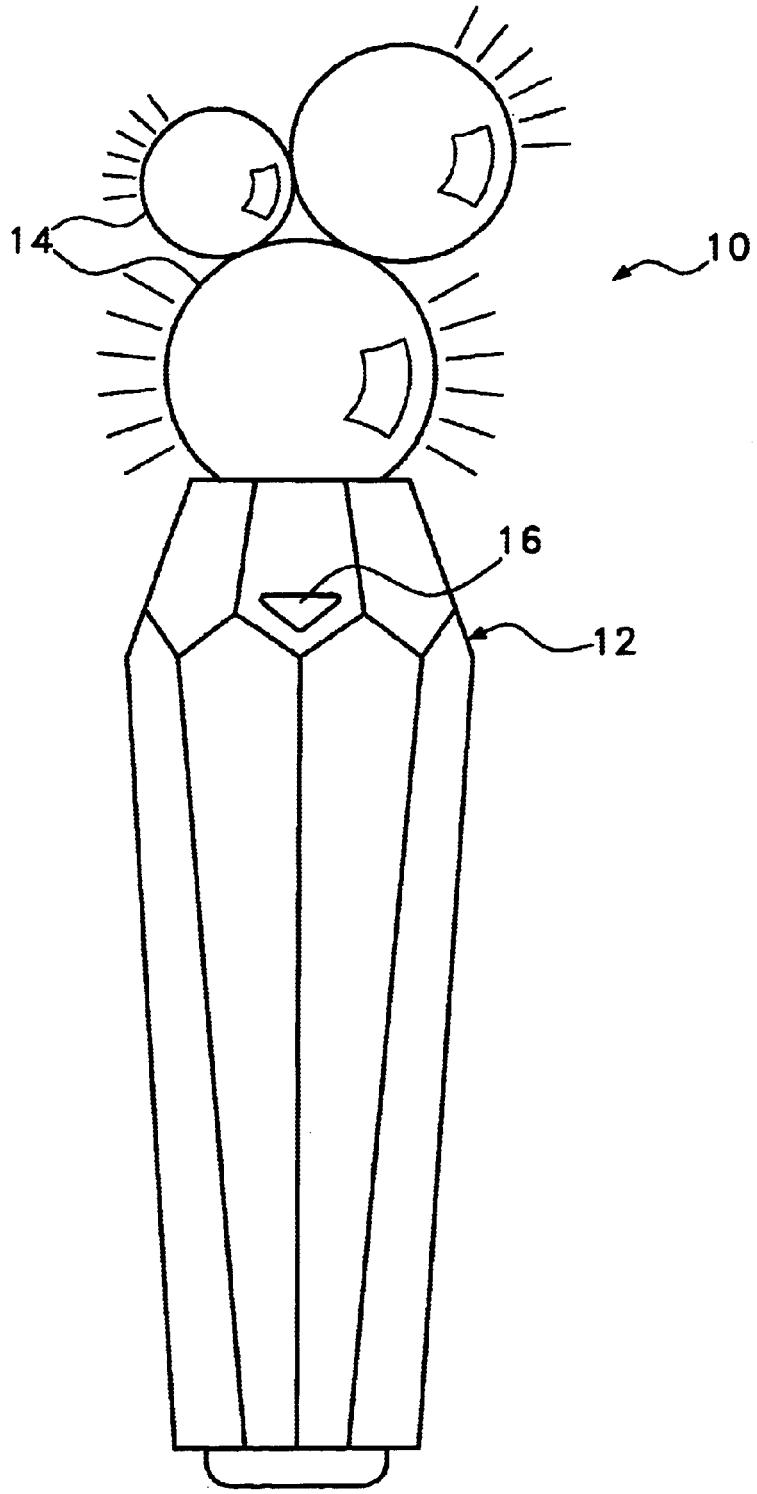
FIG. 1 is a front view of an exemplary embodiment of the present invention shown in conjunction with a plurality of bubbles.

Referring to FIG. 1, an exemplary embodiment of the present invention device 10 is shown. The device 10 contains a housing 12. At the top of the housing 12 is a concave support platform that is used to retain bubbles 14. The bubbles 14 can be either soap film bubbles or polymer film bubbles. By providing a concave support platform, a bubble need not deform out or round when it contacts the concave support platform. This significantly increases the chances that a bubble will rest upon the concave support platform without breaking. It also significantly increases the time a bubble can rest upon the concave support platform before it breaks.

An on/off switch 16 is disposed on the exterior of the housing 12. When the on/off switch 16 is manually depressed by a person holding the housing 12, at least one light source is lit in the base of the concave support platform. The light from the light source is directed upwardly into the area above the concave support platform. The light, therefore, enters any bubble 14 that is resting on the concave support platform. The bubbles 14 internally reflect the light from the light sources. The result is a bubble formation that is internally illuminated and seems to shine from all points. If multiple bubbles 14 are stacked together on top of the concave support platform, the light from the light source propagates through all of the bubbles 14. Each of the bubbles 14 in the stack of bubbles therefore becomes internally illuminated and appears to shine from all exposed points.

Figure 2:
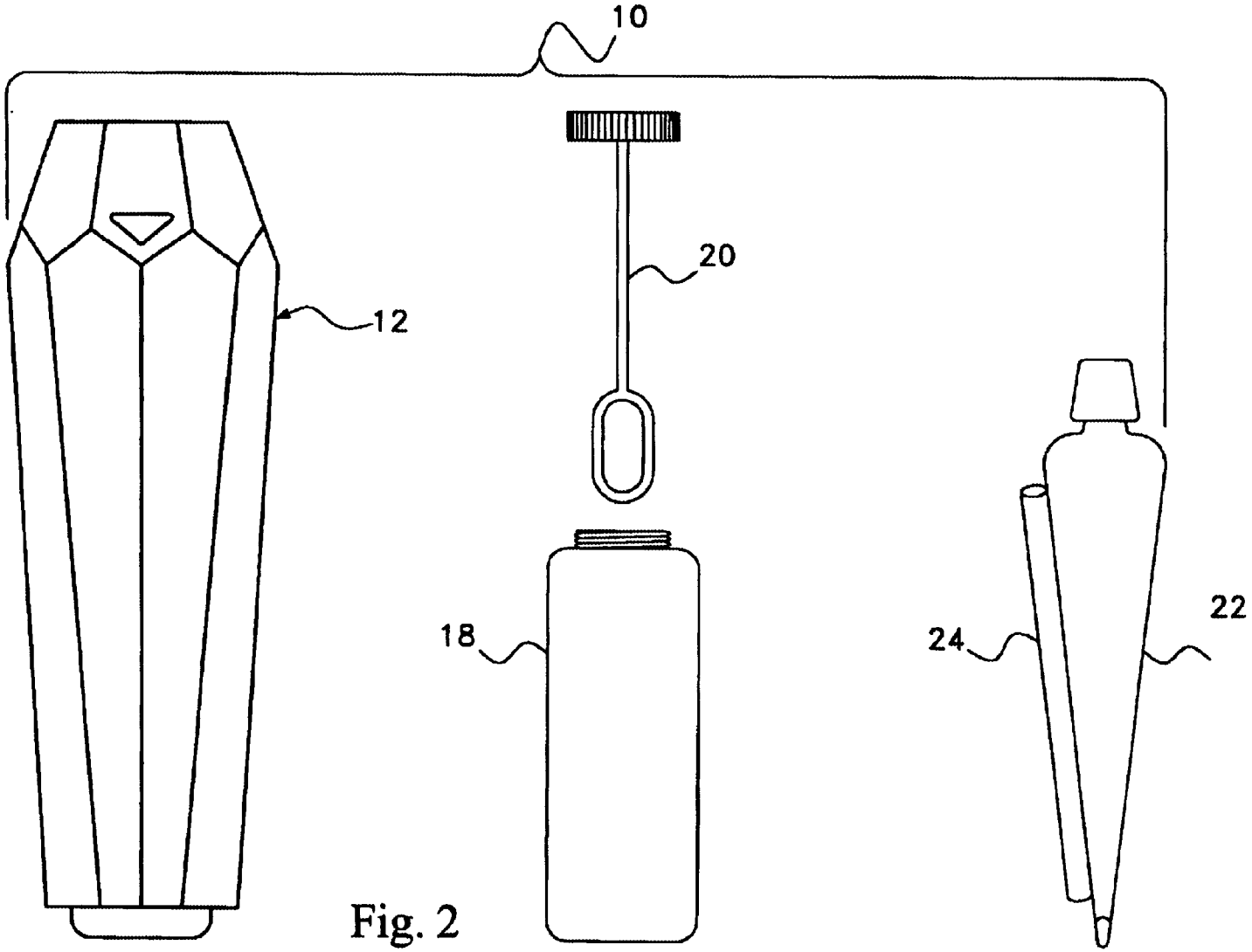
FIG. 2 is a front view of an exemplary housing of the invention shown in conjunction with two types of bubble blowing supplies that can be selectively held within the assembly.

Referring now to FIG. 2, it can be seen that the housing 12 of the device 10 also houses the supplies needed to create the bubbles. Bubble making supplies traditionally come in one of two basic forms. In a first form, a container of liquid material 18 is provided. The liquid is soap water or another surface tension bubble making composition. A wand 20 is provided. The wand 20 defines an annular opening through which a person can blow air and create a bubble from the liquid material. In a second form, a tube of polymer material 22 is provided. A short straw 24 is also provided. A small volume of the polymer material is removed from the tube 22 and is manually molded around one end of the straw 24. Air is then blown through the straw 24 to create a bubble from the polymer material.

The housing 12 of the present invention device is shaped to selectively receive and retain one of the two types of bubble making supplies. The bubble making supplies remain held within the housing 12 until a user decides to remove the bubble making supplies to make bubbles.

Figure 3:
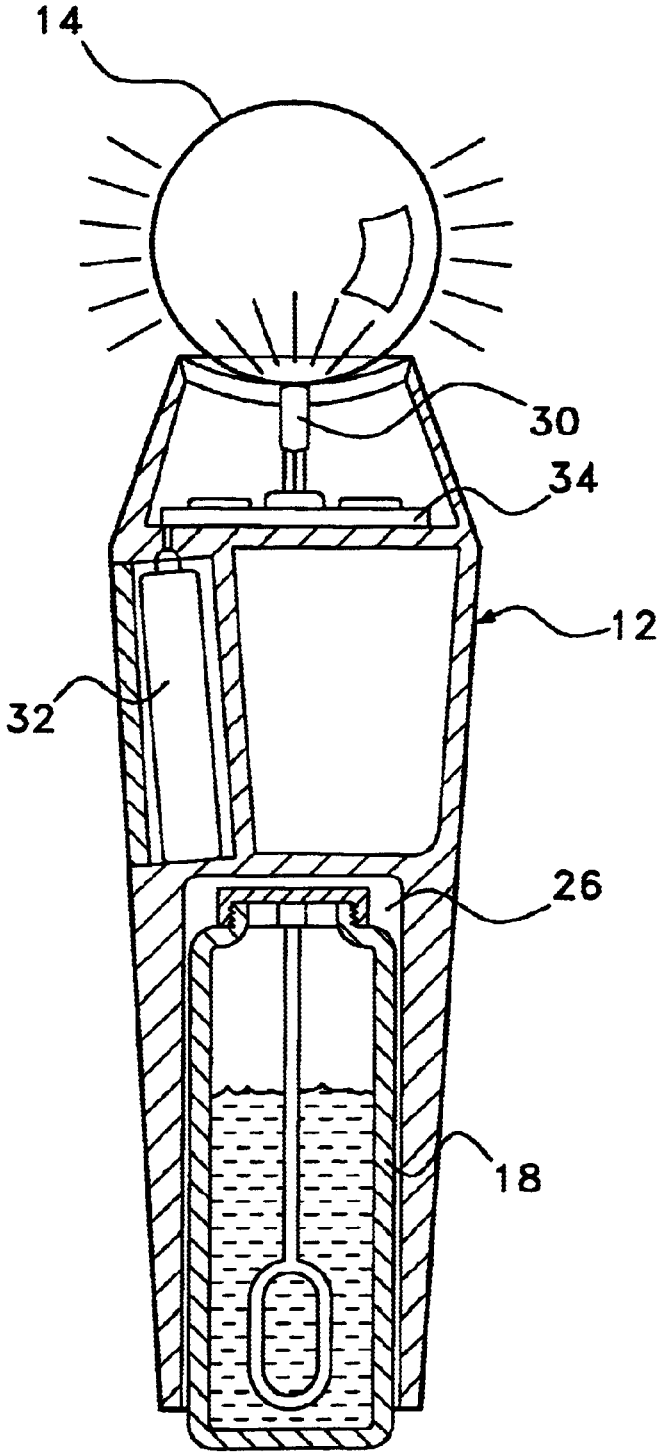
FIG. 3 is a selectively cross-sectioned view of the embodiment of the present invention shown in FIG. 1.

Referring to FIG. 3, it can be seen that in the bottom of the housing 12 is a storage chamber 26. The storage chamber 26 is sized to receive either the container of bubble liquid 18 or the tube of bubble polymer 22 (FIG. 2). In the shown embodiment, the container of bubble liquid 18 is shown within the storage chamber 26. The bubble making supplies can be retained within the storage chamber 26 using many known mechanical fastening techniques. However, it is preferred that the bubble making supplies be held within the handle storage chamber 26 using a friction fit. In this manner, a child can easily remove and replace the bubble making supplies without having to manipulate doors, latches, or other retention features.

As can best be seen from FIG. 3, at least one light source 30 is disposed in the bottom of a concave support platform 28. The concave support platform 28 can be made from transparent material either in part or in whole. As such, light from the light source 30 can shine through the concave support platform 28 into the area above the concave support platform 28, where a bubble 14 would be located. The concave support platform 28 also protects the light source 30 and its associated circuitry from soap film or other bubble material that may gather on the concave support platform 28 as bubbles pop.

The light source 30 can be an incandescent bulb but is preferably a light emitting diode (LED). The light source 30 can emit light of any color, depending upon the type of bulb or LED used. In the shown embodiment, a single light source 30 is illustrated for the purposes of simplicity. However, as is later shown by FIG. 4, it should be understood that any plurality of light sources can be used, wherein each light source would shine light up past the concave support platform.

The light source 30 is powered by at least one battery 32 that is also retained within the housing 12. Power between the light source 30 and the battery 32 is controlled by the on/off switch 16, that is shown in FIG. 1.

An optional circuit board 34 can also be used in the housing 12. The circuit board 34 supports the on/off switch 16 (FIG. 1) and can also contain control circuitry. The control circuitry can flash the light source 30 in a predetermined flashing sequence. Accordingly, the light source 30 can be flashed in a strobe pattern or a more complex pattern of long and short flashes.

Figure 4:
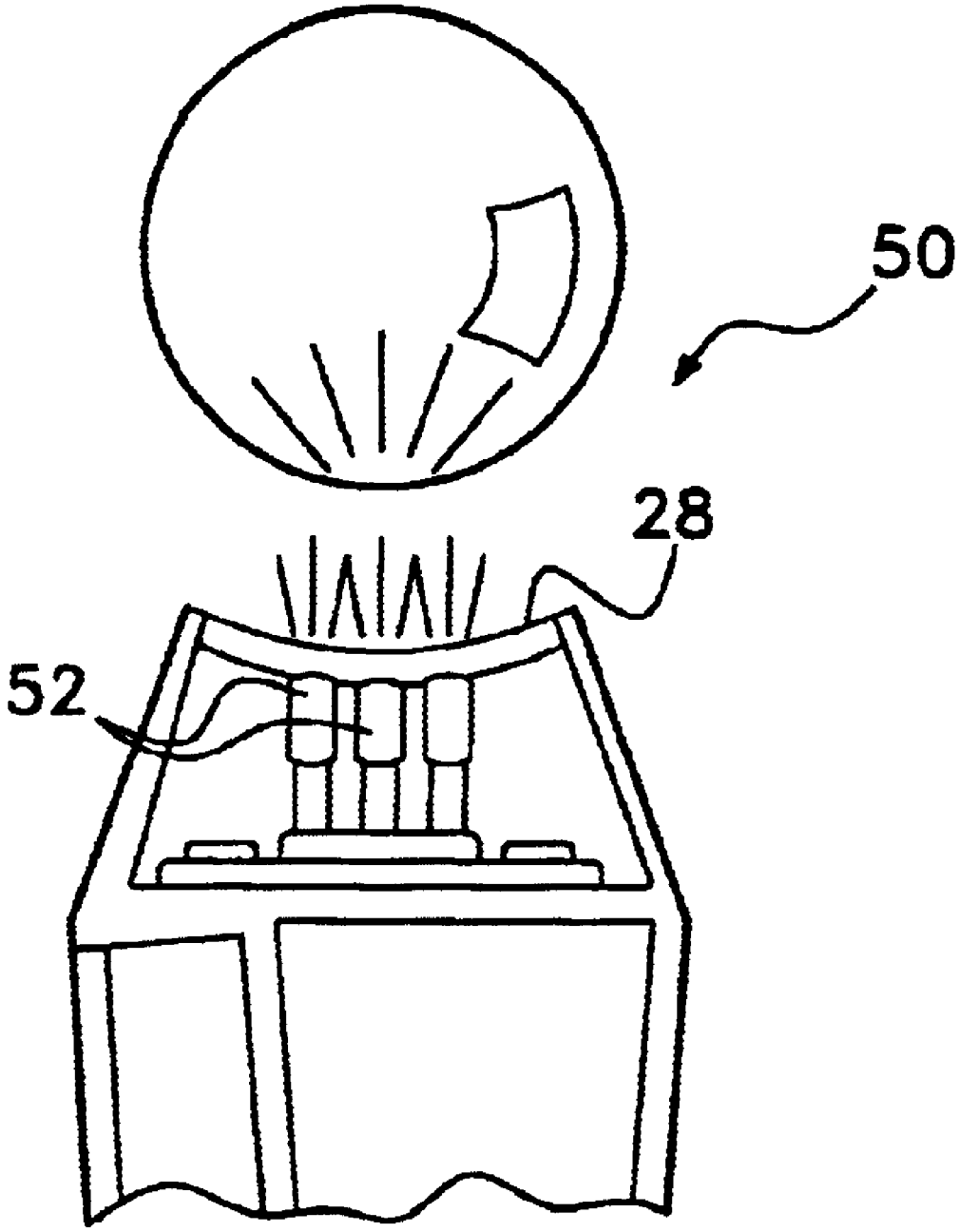
FIG. 4 is a fragmented, selectively cross-sectioned view of an alternate embodiment of the light sources contained within the present invention.

Referring now to FIG. 4, an embodiment of the present invention device 50 is shown that has a plurality of light sources 52. Each of the light sources 52 shines light into the area of space immediately above the concave support platform 28. The light sources 52 can all emit the same colored light. However, in a preferred embodiment, each of the light sources 52 emits light of a different color. Since multiple light sources 52 of different colors are used, the control circuit can individually light the different light sources 52 in a predetermined sequence. This enables the present invention device 50 to change the color of light being emitted into the bubbles. The bubbles can therefore be internally illuminated with changing colors.

As such, it will be understood that the present invention device retains the supplies needed to make bubbles. The device also provides a concave support surface upon which bubbles can be placed. Under the concave support surface is at least one light source that shines light up into the bubbles that are resting upon the concave support surface. The light can be a constant light or can be a light that is selectively flashed in a predetermined pattern.

It will be understood that the embodiments of the present invention device that are described and illustrated herein are merely exemplary and a person skilled in the art can make many variations to the embodiments shown without departing from the scope of the present invention. For example, the shape, size and appearance of the device can be altered as desired. Furthermore, the position of the bubble support surface can be repositioned, as desired. All such variations, modifications and alternate embodiments are intended to be included within the scope of the present invention as defined by the appended claims.

What is claimed is:

1. A method for illuminating bubbles, comprising:

providing a housing having a bubble support surface thereon, wherein said bubble support surface has at least one transparent area;

creating at least one bubble;

positioning said at least one bubble on said bubble support surface, so that said at least one bubble abuts against and rests upon said bubble support surface;

shining light into said at least one bubble through said at least one transparent area of said bubble support surface.

2. The method according to claim 1, wherein said step of shining light into said at least one bubble includes the substeps of:

providing at least one light source within said housing;

activating said at least one light source, wherein said at least one light source shines light into said at least one bubble through said at least one transparent area.

3. The method according to claim 1, wherein said step of shining light into said at least one bubble includes selectively flashing at least one light source in a predetermined pattern to illuminate said at least one bubble in said predetermined pattern.

4. The method according to claim 1, wherein said bubble support surface is concave.

5. The method according to claim 1, further including the step of storing bubble making supplies in said housing.

6. The method according to claim 5, wherein said step of creating at least one bubble includes removing said bubble making supplies from said housing and utilizing said bubble making supplies to make said at least one bubble.

7. A device for illuminating bubbles, comprising:

a housing having a bubble support surface on which at least one bubble can rest, wherein said bubble support surface contains at least one transparent section;

a volume of bubble making material retained within said housing, wherein said bubble making material is selectively removable from said housing;

at least one light source disposed within said housing, wherein said at least one light source shines light through said at least one transparent section of said bubble support surface when activated; and a switch for selectively activating said at least one light source.

8. The device according to claim 7, wherein said bubble support surface is concave.

9. The device according to claim 7, having multiple light sources that shine light through said at least one transparent section of said bubble support surface when activated.

10. The device according to claim 9, wherein at least some of said multiple light sources shine different colored light.

11. The assembly according to claim 9, further including a control circuit for selectively lighting said multiple light sources in a predetermined lighting sequence.

12. The device according to claim 7, wherein said volume of bubble making material is a liquid held in a container, wherein said housing selectively receives and retains said container.

13. The device according to claim 7, wherein said volume of bubble making material is held in a tube, wherein said housing selectively receives and retains said tube.

14. A device for retaining bubbles, comprising:

a housing having a top surface and internally defining a storage chamber, wherein said top surface has a concave section;

at least one light source contained within said housing that shines through said concave section of said housing;

bubble making supplies removeably stored within said storage chamber, wherein said bubble making supplies includes bubble material and a means to blow air into a volume of bubble material.

15. The device according to claim 14, wherein concave section of said top surface has at least one transparent section.

16. The device according to claim 15, wherein said at least one light source shines light through said at least one transparent section of said top surface.

17. The device according to claim 14, further including multiple light sources that shine light through said concave section of said top surface when activated.

* * * * *